US009624059B2

(12) United States Patent
Wilfong

(10) Patent No.: US 9,624,059 B2
(45) Date of Patent: Apr. 18, 2017

(54) DISPENSERS AND DISPENSING SYSTEMS FOR BAGS

(75) Inventor: Harry B. Wilfong, Hartsville, SC (US)

(73) Assignee: Hilex Poly Co., LLC, Hartsville, SC (US)

( * ) Notice: Subject to any disclaimer, the term of this patent is extended or adjusted under 35 U.S.C. 154(b) by 95 days.

(21) Appl. No.: 12/845,503

(22) Filed: Jul. 28, 2010

(65) Prior Publication Data

US 2012/0024884 A1 Feb. 2, 2012

(51) Int. Cl.

| | |
|---|---|
| ***G07F 11/72*** | (2006.01) |
| ***B65H 16/00*** | (2006.01) |
| ***B65H 35/10*** | (2006.01) |

(52) U.S. Cl.

CPC ..... *B65H 16/005* (2013.01); *B65H 35/10* (2013.01); *B65H 2701/191* (2013.01)

(58) Field of Classification Search

CPC . B65H 16/005; B65H 35/10; B65H 2701/191
USPC ..... 225/93; 221/30, 45, 46; 242/596.3
See application file for complete search history.

(56) References Cited

U.S. PATENT DOCUMENTS

| | | | | | |
|---|---|---|---|---|---|
| 320,576 | A * | 6/1885 | Myers | B65H 35/0006 | 225/85 |
| 1,229,431 | A * | 6/1917 | Farrell | A47K 10/22 | 242/596.3 |
| 1,778,282 | A * | 10/1930 | Stewart | A47K 10/40 | 242/596.3 |
| 2,049,964 | A * | 8/1936 | Lawson | A47K 10/22 | 242/596.3 |
| 2,467,825 | A * | 4/1949 | Hall | 242/596.1 | |
| 2,566,883 | A * | 9/1951 | Gove | 242/596.3 | |
| 2,879,012 | A * | 3/1959 | Sarro | A47K 10/38 | 16/DIG. 13 |
| 3,799,466 | A * | 3/1974 | Adams | B65H 16/06 | 242/594.3 |
| 4,106,733 | A * | 8/1978 | Walitalo | 248/100 | |
| 4,634,067 | A * | 1/1987 | White | 242/596.4 | |
| 4,858,840 | A * | 8/1989 | Kidman | A47K 10/38 | 242/596.3 |
| 5,868,275 | A * | 2/1999 | Moody | A47K 10/16 | 221/33 |
| 5,934,535 | A * | 8/1999 | Kannankeril et al. | 225/106 | |
| 6,098,919 | A * | 8/2000 | Lewis | A47K 10/40 | 242/596.3 |
| 6,138,939 | A * | 10/2000 | Phelps et al. | 242/596.7 | |
| 6,279,806 | B1 * | 8/2001 | Simhaee | 225/106 | |
| 6,450,380 | B1 * | 9/2002 | Simhaee | A47F 9/042 | 221/26 |
| 7,090,106 | B2 * | 8/2006 | Holden | 225/106 | |

(Continued)

OTHER PUBLICATIONS

PCT International Search Report in PCT Patent Application No. PCT/US2011/044647.

(Continued)

*Primary Examiner* — Rakesh Kumar
(74) *Attorney, Agent, or Firm* — Nelson Mullins Riley & Scarborough LLP

(57) ABSTRACT

A dispenser for bags is disclosed. The dispenser is capable of storing a roll of bags and dispensing individual bags therefrom. In addition, a dispensing system for use in dispensing individual bags from a wound roll of continuously and detachably connected bags is disclosed.

13 Claims, 15 Drawing Sheets

(56) References Cited

U.S. PATENT DOCUMENTS

| | | | | |
|---|---|---|---|---|
| 7,591,405 | B2 * | 9/2009 | Daniels | B26F 3/02 225/106 |
| 2003/0098326 | A1 | 5/2003 | Wile | |
| 2004/0007607 | A1 | 1/2004 | Daniels | |
| 2006/0006276 | A1 * | 1/2006 | Wyatt | B65H 49/22 242/588 |
| 2012/0024884 | A1 * | 2/2012 | Wilfong | B65H 16/005 221/30 |

OTHER PUBLICATIONS

PCT Written Opinion of the International Searching Authority in PCT Patent Application No. PCT/US2011/044647.
PCT International Search Report and Written Opinion of the International Searching Authority dated Oct. 19, 2011 and International Preliminary Report for PCT/US2011/044647 filed on Jul. 20, 2011.

* cited by examiner

DISPENSERS AND DISPENSING SYSTEMS FOR BAGS

FIELD OF INVENTION

The present invention relates to dispensers and dispensing systems for bags.

BACKGROUND

Consumers and shoppers purchasing items, such as produce or other grocery items, often use bags to collect and carry those items. In many stores, the bags are stored in and dispensed from dispensers.

SUMMARY OF THE INVENTION

The present invention provides a novel and useful dispenser for bags. In one embodiment, the invention is a dispenser that includes one or more braking surfaces for contacting a portion of a wound roll of bags; two support arms configured to receive a wound roll of bags therebetween; at least one tab on each support arm configured to engage a core of the wound roll of bags and to provide an inward force against the wound roll of bags; and a separator positioned relative to the braking surface to separate an individual bag from the wound roll of bags. In addition, the two support arms are positioned relative to the one or more braking surfaces so as to allow the wound roll of bags to contact at least one of the braking surfaces when the core of the wound roll of bags is engaged by the tabs. The two support arms also are configured to swivel so that the wound roll of bags remains in contact with at least one of the braking surfaces as the wound roll of bags is depleted.

In another embodiment, the present invention is a dispensing system for dispensing individual bags from a wound roll of bags. In one embodiment, the dispensing system includes a wound roll of bags having a core and comprising a plurality of bags that are continuously and detachably connected. The dispensing system also includes a dispenser that includes a braking surface for contacting a portion of a wound roll of bags; two support arms configured to receive a wound roll of bags therebetween; at least one tab on each support arm configured to engage a core of the wound roll of bags and to provide an inward force against the wound roll of bags; and a separator positioned relative to the braking surface to separate an individual bag from the wound roll of bags. In addition, the two support arms are positioned relative to the braking surface so as to allow the wound roll of bags to contact the braking surfaces when the core of the wound roll of bags is engaged by the tabs. The two support arms also are configured to swivel so that the wound roll of bags remains in contact with at least one of the braking surfaces as the wound roll of bags is depleted. In the dispensing system, the tabs engage the core of the wound roll of bags, and a portion of the wound roll of bags contacts a portion of the braking surface.

The present invention may be better understood by reference to the description and figures that follow. It is to be understood that the invention is not limited in its application to the specific details as set forth in the following description and figures. The invention is capable of other embodiments and of being practiced or carried out in various ways.

BRIEF DESCRIPTION OF THE DRAWINGS

These and other features, aspects, and advantages of the present invention are better understood when the following Detailed Description is read with reference to the accompanying drawings, wherein.

DETAILED DESCRIPTION OF EXEMPLARY EMBODIMENTS

Figure 1:
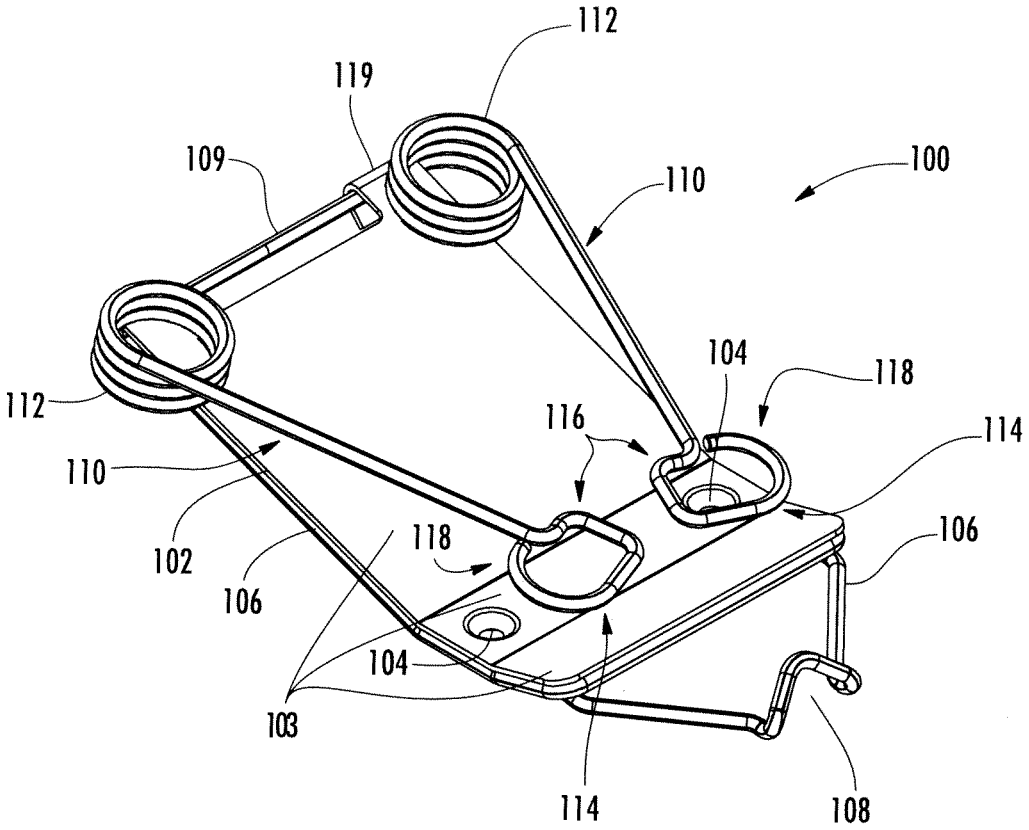
FIG. 1 is a perspective view of a dispenser in accordance with an embodiment of the present invention.

The use of reference characters with the same two ending digits as other reference characters to indicate structure in the present specification and drawings, without a specific discussion of such structure, is intended to represent the same or analogous structure in different embodiments. For example, and as further seen herein, the structures indicated by reference characters 108, 508, 608, 708, and 808 all indicate the separator of a bag dispenser in various embodiments of the present invention.

Figure 2:
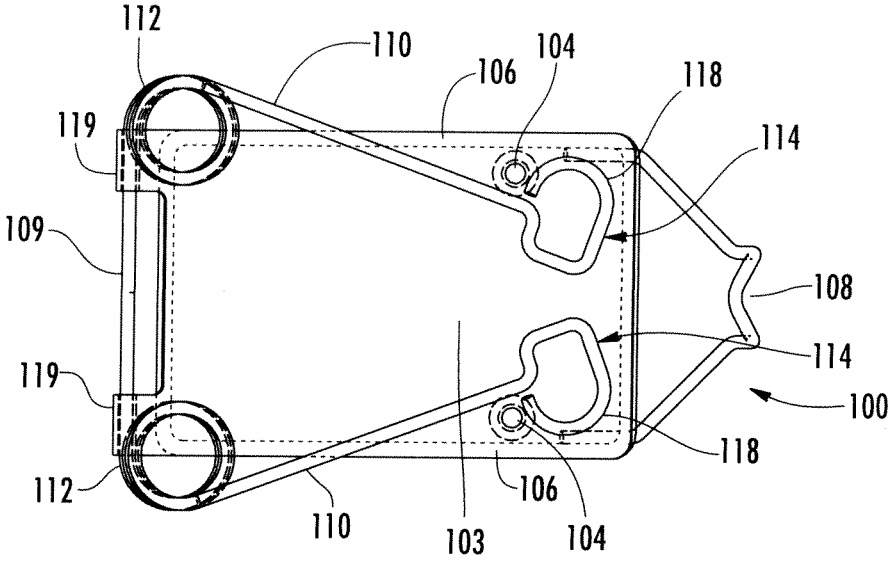
FIG. 2 is a top view of the dispenser embodiment illustrated in FIG. 1.
Figure 3:
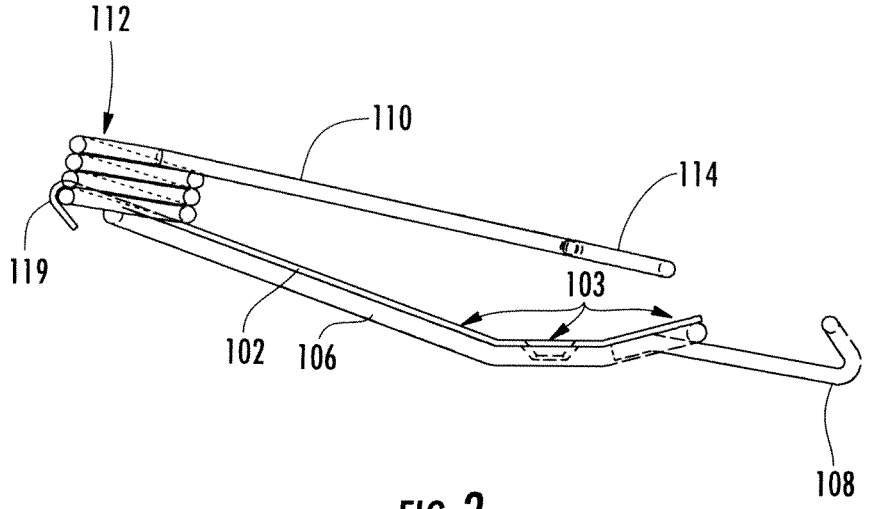
FIG. 3 is a side view of the dispenser illustrated in FIG. 1.

Embodiments of the present invention include bag dispensers and dispensing systems for a wound roll of continuously and detachably separable bags, and FIGS. 1-3 depict an illustrative embodiment of a dispenser of the present invention in which dispenser 100 has plate 102 with braking surface 103, frame 106, support arms 110, tabs 114, and separator 108. As depicted in FIG. 1, plate 102 is shown as a single plate that may be formed in a three-sided cradle position. In alternative embodiments, more than one plate 102 may be present, with each plate 102 optionally adhered or joined to another plate 102 or spaced apart from each other. In further embodiments, plate 102 can be planar or of various shapes and geometric configurations. In alternative embodiments, dispenser 100 can have an open construction made of wire or frame without plate 102.

Figures 8A, 8B, 8C:
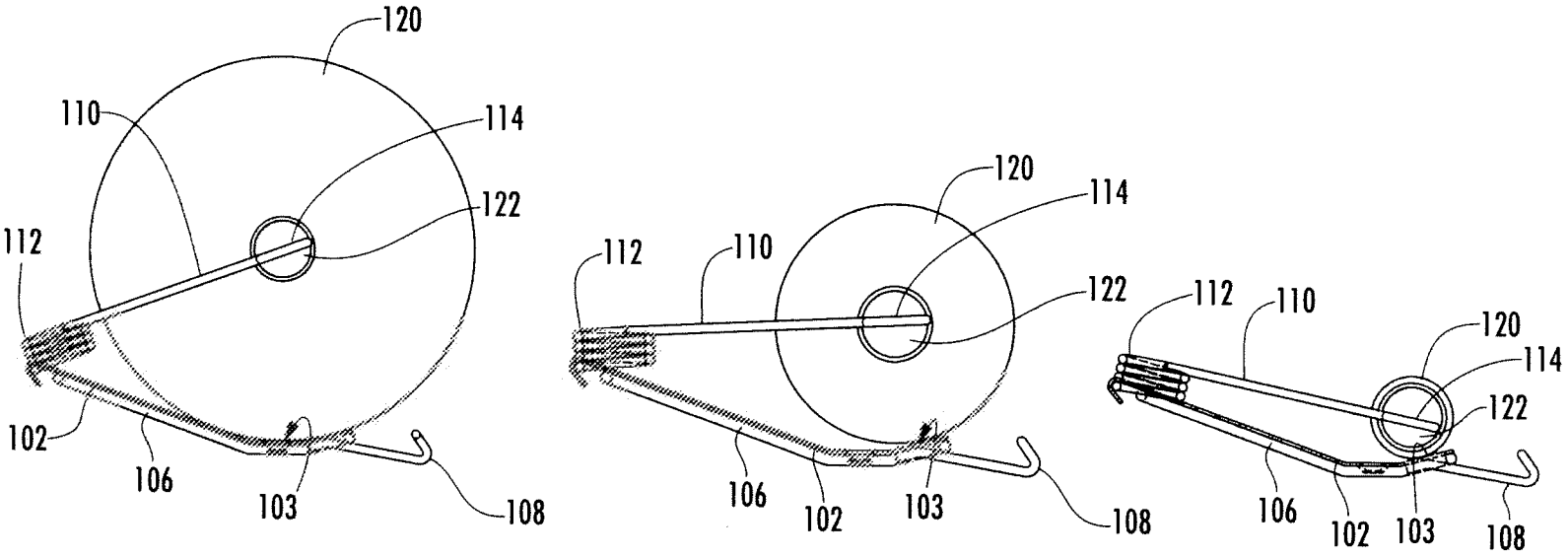
FIG. 8A is a side view of the dispenser in FIG. 1 having a roll of bags loaded thereon.
FIG. 8B is a side view of the dispenser in FIG. 8A after the roll of bags has been partially depleted.
FIG. 8C is a side view of the dispenser in FIG. 8C after the roll of bags has been further depleted.

Plate 102 has braking surface 103, which is positioned to have at least partial contact with a roll of bags when loaded in dispenser 100. In some embodiments having more than one plate 102, each plate 102 may have braking surface 103. In other embodiments having more than one plate 102, less than each plate 102 will have braking surface 103. In alternative embodiments, frame 106 may have braking surface 103 in addition to or in lieu of braking surface 103 on plate 102. As shown in FIGS. 8A-8C, the portions of braking surface 103 that may contact a roll of bags 120 may vary as the roll of bags 120 is depleted.

In the embodiment shown in FIGS. 1-2, plate 102 has mounting holes 104, which can vary in number, size, and location in accordance with the present invention. Mounting holes 104 permit dispenser 100 to be attached to a post, wall, stand, counter, shelf, or other suitable supporting beam or surface by use of conventional fasteners such as nails, screws, bolts, or the like. In alternative embodiments, mounting holes 104 are optional and dispenser 100 can be attached to a surface or structure using alternative attachment means that are readily known in the art, such as adhesion. In other embodiments, dispenser 100 can rest freely on a surface, such as a counter top or shelf, without the use of mounting holes 104, fasteners, or any attachment means.

As shown in FIGS. 1 and 2, plate 102 is mounted onto frame 106, which extends under the braking surface as shown with dashed lines in FIG. 2. As illustrated in FIGS. 1-2, separator 108 is attached to plate 102, which can be by any conventional means, such as welding or bonding. In alternative embodiments, separator frame 108 may be attached to frame 106. In other embodiments, frame 106 may be a wire frame and may extend beyond plate 102 to form separator 108, in which embodiment frame 106 and separator 108 are integral. In yet other embodiments, separator 108 may be integral with or attached to plate 102, and frame 106 may optionally be excluded from dispenser 100.

Separator 108 can have various shapes and formations. As shown in FIG. 1, separator 108 is a tongue pointed upwards. In other embodiments, separator 108 can be a tongue pointed downwards. In alternative embodiments, separator 108 can be any structure that is configured to separate a bag from a wound roll of bags. Examples of separators that can be used in the present invention are disclosed in U.S. Published Patent Application No. 2010/0316309 (U.S. patent application Ser. No. 12/813,695, filed on Jun. 11, 2010) and which is incorporated herein in its entirety by reference thereto. By way of example, separator 108 can be a double tongue or a plate with a slot. In some embodiments, separator 108 may be angled in a direction toward frame 106.

In addition, the position of separator 108 can be varied so long as it is positioned to engage and separate a bag being dispensed from the dispenser. In some embodiments, separator 108 may be located in close proximity to a loaded roll of bags. In some embodiments, separator 108 may be located about 0.5 to 1.0 inch from a roll of bags. In addition, the top of separator 108 may be in the same plane as the most immediate portion of the braking surface, as shown in FIG. 3 with regard to plate 102 and separator 108.

Figure 4:
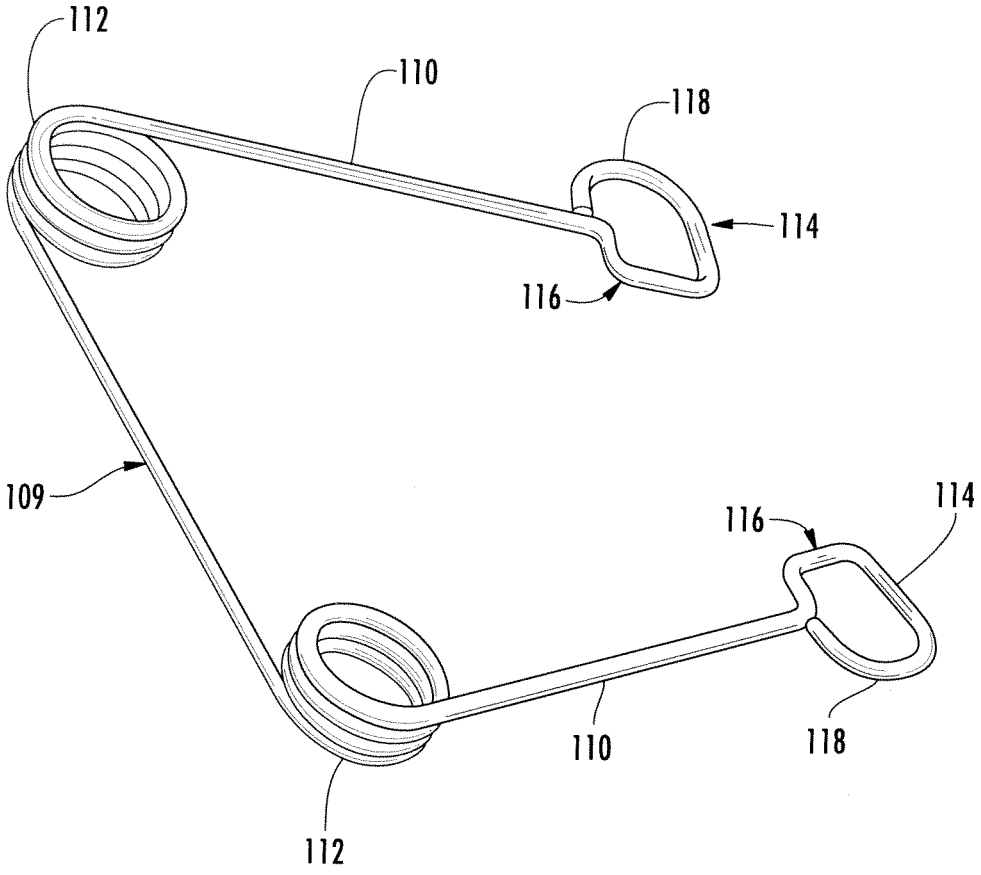
FIG. 4 is a perspective view of the support arms, tabs, and spring coils of the dispenser embodiment illustrated in FIG. 1.
Figure 5:
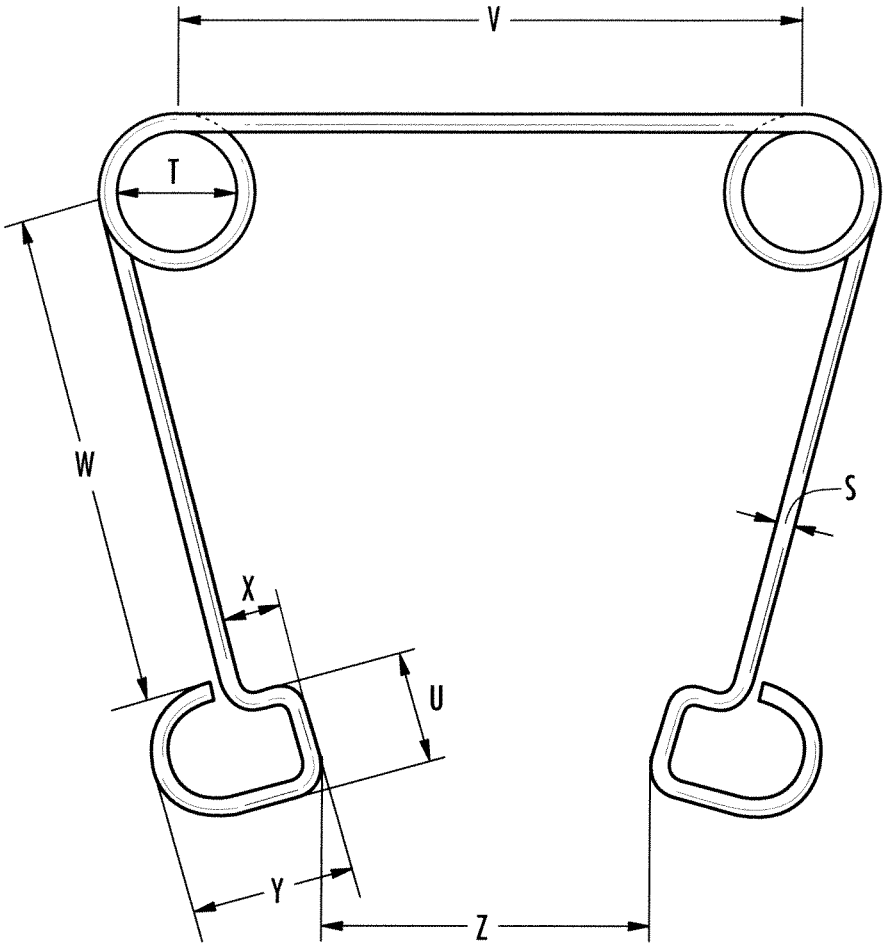
FIG. 5 is a schematic top view of the components illustrated in FIG. 4.

As shown in FIGS. 1-2 and in isolation in FIGS. 4-5, wire 109 forms support arms 110, spring coils 112 (depicted as each having three coils in the particular embodiment shown in FIGS. 1-2 and 4-5), and tabs 114. Although support arms 110, spring coils 112, and tabs 114 are shown in FIG. 1 as integrally formed from wire 109, some or all of these components may be constructed of other material and adhered or connected together by conventional means in alternative embodiments. In some embodiments, one support arm 100, one spring coil 112, and one tab 114 may be integrally formed.

As illustrated in FIG. 1, tabs 114 include inner engagement tab 116 and outer grasping tab 118. However, it will be appreciated that tabs 114 can have alternative shapes and configurations that engage the core of a wound roll of bags. As shown in FIG. 1, tabs 114 may not extend through the entire core of a wound roll of bags, and some embodiments of dispenser 100 require at least two support arms 110 and two tabs 114.

In addition, as illustrated in FIG. 1, tabs 114 may be biased inwardly towards each other. The inward bias of tabs 114 may result from an inward bias of support arms 110. In particular, support arms 110 may be biased inward due to the bending of support arms 110 and/or bias provided by the closest spring coil 112 to each support arm 110. In some embodiments, the distance between tabs 114 at their default resting position is less than the width of a roll of bags used with dispenser 100.

Holder 119 (depicted as a crimp or bend in plate 102) engages wire 109 and attaches wire 109 to plate 102 in a manner that permits support arms 110 to swivel as described subsequently herein with respect to FIGS. 8A-C and 9. Although holder 119 is depicted as a crimp or bend in plate 102, it will be apparent to one of ordinary skill in the art that different attachments can be used that permit the support arms 110 to swivel as described herein, and such mechanisms are within the scope of the present invention. In other embodiments, support arms 110 may not be directly or indirectly connected to each other and each support arm 110 may be independently attached to frame 106 or plate 102.

In certain embodiments of the present invention, support arms 110 and spring coils 112 may be constructed of wire, such as stainless steel wire. In some embodiments, it is beneficial if the wire has an adequate combination of flexibility and force for the dispenser to function as described subsequently herein. Wire having a composition and hardness suitable for the manufacture of springs, such as music wire per ASTM Specification A228, which is available from suppliers such as United Wire Company, Inc. of New Haven, Conn., has been found to provide the adequate properties in some embodiments of the present invention.

In addition, the placement and number of spring coils 112 in dispenser 100 is a factor in providing the requisite inward force of the tabs 114. Although each set of spring coils is shown in FIG. 1 as having three coils, the number of coils will vary based upon the location and wire used in a particular dispenser and the desired bias force.

The dimensions of the components of the dispenser can vary based upon the parameters of rolls of bags to be used with the dispenser, but the dimensions should ensure that adequate force is applied to the roll of bags by the tabs as described herein. In certain embodiments, the default resting distance between the tabs is less than the width of the roll of bags for use with the dispenser. Although any dimensions that offer the functionality of the dispenser are within the scope of the present invention, approximate dimensional ranges for illustrative embodiments of the invention include the following with reference to the dimension characters of FIG. 5:

S: 0.125" to 0.1875"
T: 0.75" to 1.25"
U: 0.75" to 1.25"
V: 3" to 5"
W: 3" to 5"
X: 0.25" to 0.75"
Y: 1" to 2"
Z: 0.5" to 2"

In one particular example, the dispenser may have the following dimensions: S=0.156"; T=1.03"; U=0.96"; V=4"; W=4.25"; X=0.5"; Y=1.38"; and Z=0.54". Other embodiments may have proportions that are approximately relative to these dimensions.

Figure 6:
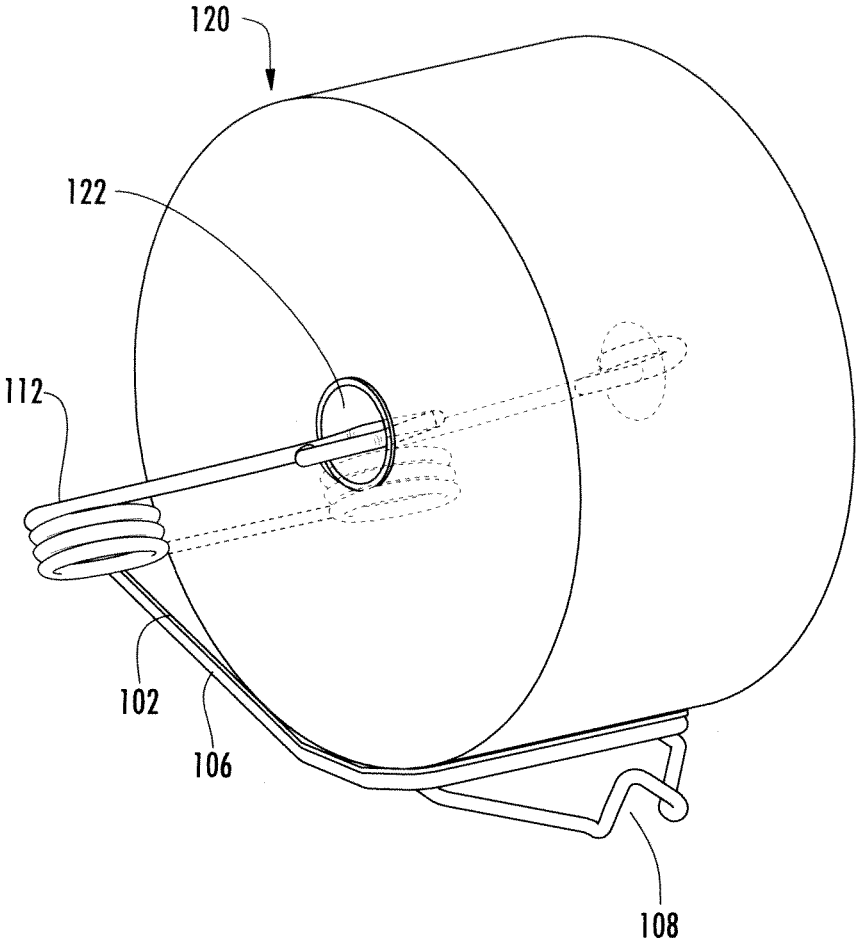
FIG. 6 is a perspective view of the dispenser embodiment illustrated in FIG. 1, wherein the dispenser is loaded with a roll of bags.

As indicated, the dispenser of the present invention is for use with a roll of bags. FIG. 6 depicts the embodiment of FIG. 1 in which a roll of bags 120 having a core 122 has been loaded onto the dispenser. Core 122 can be the inner most bag itself but is more desirably one or more tube-like inserts within the bag that are constructed of a durable material, such as plastic, and that spans some or all of the width of the roll of bags 120. In some embodiments, as illustrated in FIG. 6, core 122 may be completely hollow.

Although it will be readily apparent to a person having ordinary skill in the art that numerous types of bags may be used with dispenser embodiments of the present invention, some rolls of bags used with the present invention may have a plurality of continuously and detachably separable bags. An example of a roll of bags that can be used in the present invention is disclosed in U.S. Published Patent Application No. 2010/0316309 (U.S. patent application Ser. No. 12/813,695).

Figure 7:
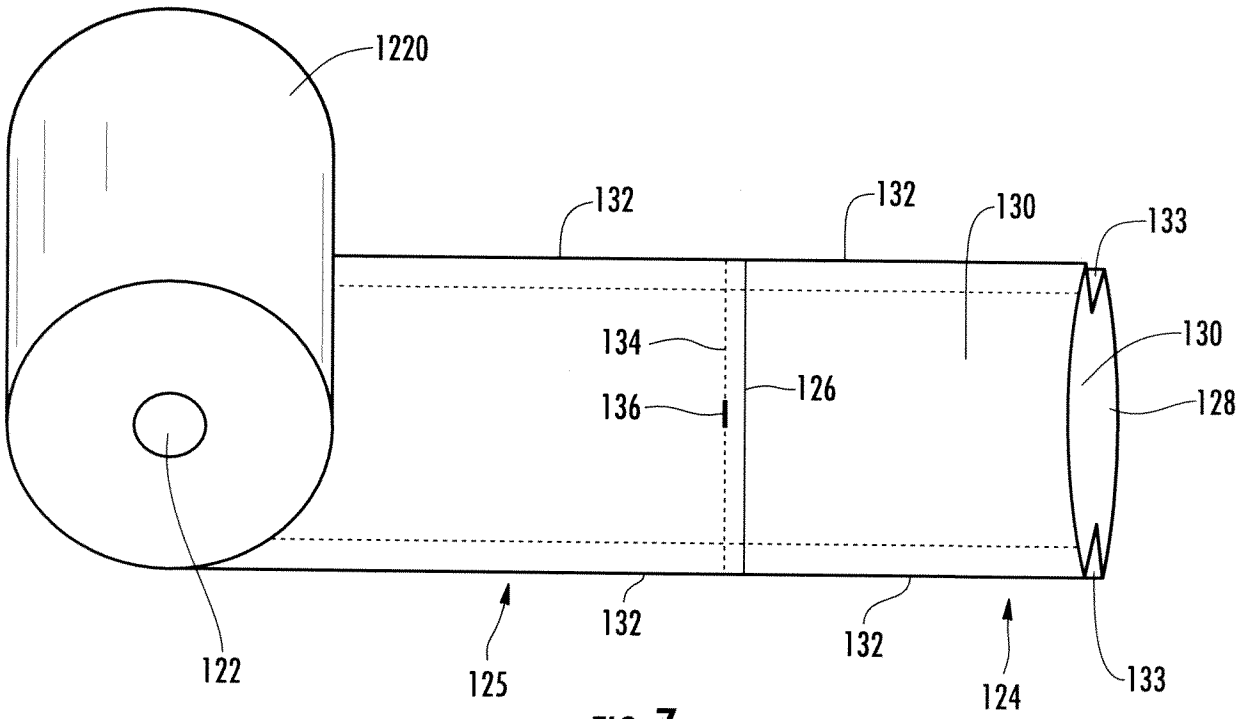
FIG. 7 is a front view of a bag that may be used in connection with the dispenser embodiment of FIG. 1.

As an example of a roll of bags that may be used with dispensers of the present invention, FIG. 7 illustrates in more detail roll of bags 120 shown in FIG. 6. As shown in FIG. 7, roll of bags 120 with core 122 has been partially unwound to show bag 124 and bag 125. As depicted, bag 124 has a bottom end 126 that is formed by a heat seal, a mouth end 128, two opposing faces 130, and two opposing lateral sides 132. As shown, bottom end 126 and mouth end 128 are on opposing longitudinal ends. In the depicted embodiment, bag 124 is shown with gussets 133 on each side 132. Bag 125, which is identical to bag 124 but without all features shown in the illustration, is continuously and detachably connected to bag 124 by perforation line 134. Perforation line 134 generally comprises alternating cuts, in which the tubing forming the bag is severed, and the uncut portions between the cuts in the perforation line are called ties.

FIG. 7 also depicts center slit 136 in perforation line 134, although it will be understood by one of ordinary skill in the art that center slit 136 alternatively can be located on either longitudinal side of perforation line 134, such as closer to mouth end 128 or bottom end 126. In another embodiment, the center slit 136 can alternatively be located closer to one of opposing lateral sides 132. In similar manner, additional bags are continuous and detachably connected in series similar to the arrangement and attachment of bag 124 to bag 126 and are wound into a roll of bags 120. It is apparent that other types of bags are contemplated for use in the present invention, including, for example, folded or unfolded, gusseted or nongusseted, sealed or star-sealed bags, and combinations thereof. Other bags for use with the dispenser of the present invention are readily apparent to those of ordinary skill in the art.

In order to load roll of bags 120 onto dispenser 100, with reference to FIGS. 1 and 6 for illustration, tabs 114, which are biased inwards toward each other, may be pulled outwardly apart from each other to separate them with sufficient distance such that a roll of bags can be placed between them. For convenience, the user may grasp outer grasping tabs 118, when present, to assist with separating tabs 114 to load the roll of bags. After placing roll of bags 120 between tabs 114 such that engagement tabs 116 are aligned with core 122, tabs 114 are released and permitted to move back inwardly toward each other such that engagement tabs 116 engage core 122 of the roll of bags 120 (as shown in FIGS. 6 and 8A-C). It is beneficial in some dispenser embodiments of the present invention if support arms 110 swivel at a point such that roll of bags 120 maintains a constant or approximately constant distance from separator 108.

When a roll of bags 120 is loaded on the dispenser of the present invention, the roll of bags may be automatically centered with respect to separator 108, i.e., the roll of bags may be aligned in the left to right direction such that an optional center slit (not shown) on the bags in the roll is aligned with the dispenser's separator 108. This feature avoids the necessity of a user having to manually center the bags on the dispenser and eliminates centering errors. In addition, the support arms 110 and tabs 116 maintain the roll of bags 120 in a centered position, which prevents the roll of bags from undesirably wobbling or sliding as observed in other types of dispensers. Tabs 114 engagement with the core of the roll of bags also prevents the roll from undesirably "jumping" out of the dispenser when a hag is pulled by a user for dispensing, which has been found to occur in some other commercial dispensers (especially when the user pulls on the bag being dispensed with a large degree of force and the roll of bags is nearing depletion and has less mass). In addition, as a result of tabs 114 positioning roll of bags 120, roll of bags 120 may be automatically centered and positioned in the front to back direction within dispenser 100 due to the cradle shape of the plate 102 and the positioning by tabs 114.

With reference to FIG. 6, because a roll of bags is loaded between tabs 114, which may be biased inward, dispenser 100 may advantageously allow for the use of rolls of bags having different widths. For example, in some embodiments of the present invention, a dispenser can hold a roll having a width from three inches to five inches. In other embodiments of the present invention, both smaller or larger rolls width rolls of bags can be used. In addition, unlike other commercial dispensers, there is no need for the core of the roll of bags to be greater than the width of the roll of bags for use with the dispenser of the present invention, which results in material, cost, and waste savings.

With reference to FIGS. 1, 6, and 7, a person desiring to dispense a bag from dispenser 100, such as a shopper or consumer, may pull the outermost bag (bag 124) on roll of bags 120 toward separator 108. When a user pulls bag 124 from roll of bags 120 toward separator 108, center slit 136 may be engaged by separator 108. As a result, separator 108 may provide a force to begin tearing perforation line 134 in each outward direction from center slit 136. As a result of perforation line 134 tearing, bag 124 may be separated and dispensed from roll of bags 120. In other embodiments, the bags may lack a center slit 136 and the separator 108 could directly engage perforation line 134.

Figure 9:
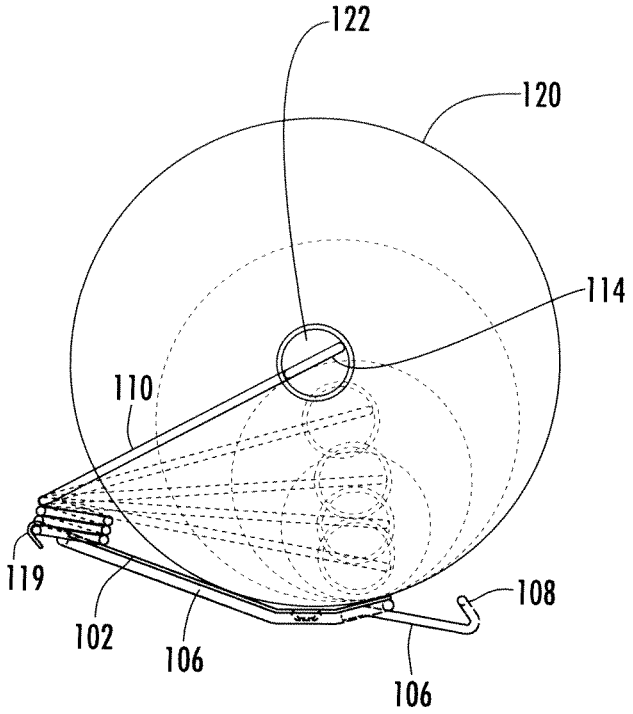
FIG. 9 is a side view of the dispenser of FIG. 1 with a loaded roll of bags illustrating various positions of the dispenser components as the roll of bags becomes depleted.

In operation, the dispenser of the present invention may beneficially prevent or significantly diminish any overspin (or freewheeling) of the roll of bags by applying various braking forces to the roll of bags. First, a gravitational force provides a braking function. For instance, FIGS. 8A-8C depict a side view of the embodiment of dispenser 100 shown in FIG. 1 at various stages of the dispensing process as roll of bags 120 have been gradually depleted. Similarly, FIG. 9 depicts this depletion of the roll of bags with shadow images. As illustrated, because support arms 110 are capable of rotating or swiveling in a direction such that a portion of roll of bags 120 remains in contact with braking surface 103 as roll of bags 120 is depleted. As a result, a downward gravitational force exists that is proportional with the mass of the roll of bags, and this force serves a braking function on the roll of bags 120 against braking surface 103. A frictional braking force also exists due to the contact of the roll of bags 120 against braking surface 103.

In addition, because support arms 110 and, correspondingly, tabs 114 may be biased inwardly towards each other, there may also be an inward force exerted on each side of roll of bags 120 by tabs 114. In certain embodiments, this force may result from the resting (or default) position between tabs 114 being a lesser distance than the width of a loaded roll of bags 120. This force that is applied by tabs 114 may provide a braking mechanism that prevents or reduces overspin (or freewheeling) of roll of bags 120 during dispensing. In addition, as indicated above, this configuration may also permit a dispenser of the present invention to accommodate rolls of bags of various widths due to the possibility of tabs 114 being separable to varying degrees.

Dispensers of the present invention may provide a sufficient braking force to reduce or eliminate the roll of bags overspinning or freewheeling even as a roll of bags is depleted. This operation is advantageous over previous dispensers in which a roll of bags is more likely to overspin as the number of bags is diminished due to the decreased gravitational and frictional forces. As a result, partially-diminished rolls of bags prone to overspinning have been conventionally discarded prematurely when used with previous dispensers, thereby increasing costs and waste.

In particular, with dispensers of the present invention, such as shown in FIGS. 8A-8C, a larger roll of bags 120 shown in FIG. 8A contacts greater surface area of braking surface 103 than the smaller (more depleted) roll of bags in FIG. 8C. In addition, the mass of the larger roll of bags 120 in FIG. 8A is greater than the mass of the more depleted roll of bags 120 in FIG. 8C. As a result, the gravitational force and friction on the roll of bags in FIG. 8A is greater than that force on the more depleted roll of bags 120 in FIG. 8C. Furthermore, as compared with the more depleted roll of bags 120 in FIG. 8C, there is also a greater mechanical advantage for dispensing the larger roll of bags 120 shown in FIG. 8A, such that the pull force felt by a user to dispense a bag is not excessive for a large roll of bags.

However, as support arms 110 swivel toward braking surface 103 as roll of bags 120 is depleted, the inward force from tabs 114 is not diminished but instead remains constant. As a result, an adequate amount of force is applied to the roll of bags 120 to prevent overspin even as the bags are used. This function is advantageous over previous dispensers that have insufficient braking force as the number of bags is being diminished. In addition, although the mechanical advantage is decreased as the bags are depleted, the gravitational and frictional braking forces have diminished. As a result, the user may experience a nearly constant pull force to dispense a bag as the bags are depleted.

As discussed above, the bias force applied by tabs 114 to a roll of bags 120 in the present dispenser is a significant factor in the operation of the dispenser of the present invention. The force necessary to separate tabs in dispensers of the present invention relates to the amount of force applied to a roll of bags after being loaded. In some embodiments of the present invention, the inward force of tabs when engaged with the core of a loaded roll of bags is from about 0.5 pounds of pressure to about 2.0 pounds of pressure, which corresponds with a deflection of about 0.5 to about 2.0 inches of deflection of tabs in certain embodiments.

In addition, embodiments of the dispenser having a spring coil, and particularly a spring coil associated with each support arm such as spring coils 112 in FIG. 1, provide for a range of motion such that tabs can be separated to accommodate a wide variety of widths of bag rolls. By contrast, support arms that do not have spring coils, such as the embodiments shown in FIGS. 13A-B and 14, may have a limited range of motion, thereby restricting the range of bag roll widths that can be loaded. For example, the inward pressure of tabs at a point with the arms deflected to be approximately parallel in a dispenser embodiment having two spring coils (with three coils per spring coil) was measured at 2.0 pounds of pressure, whereas the same measurement for tabs on a u-shaped wire without spring coils was measured at 10.5 pounds of pressure. Accordingly, dispenser embodiments having spring coils may permit the use of a larger range of bag widths than similar dispenser embodiments without spring coils.

Tests confirm that dispensers of the present invention in which tabs provide an inward bias on a roll of bags beneficially decrease or eliminate the likelihood of the roll of bags overspinning or freewheeling. In particular, the force necessary to pull a bag forward on a roll of bags having a width of 3.75 inches was measured on multiple dispensers at two stages: (i) when the roll had a 7-inch diameter and weighed 4.39 pounds and (ii) after being partially depleted such that the roll diameter was reduced to 1.5 inches and the weight was reduced to 0.09 pounds. Three alternative dispensers were tested: (i) a commercial dispenser available in the market that is similar to the dispenser shown in FIG. 7 of U.S. Pat. No. 6,279,806, (ii) a dispenser of the present invention having the embodiment shown in FIG. 1, and (iii) a cradle dispenser in which the roll of bags freely rests without any inward bias, as depicted in FIG. 2 of U.S. Pat. No. 7,270,256. Each bag was tested using a slow, medium, and fast pull, and the following results indicate the average pull force required to pull a bag forward using each dispenser:

| Roll Diameter | Commercial Dispenser | Invention Embodiment | Cradle Dispenser |
|---|---|---|---|
| 7" | 2.45 LBS | 3.05 LBS | 2.2 LBS |
| 1.5" | 1.1 LBS | 2.1 LBS | 0.05 LBS |

A greater requisite force to pull a bag forward indicates that a greater braking force exists on the roll of bags. With a greater braking force, the roll of bags is less likely to overspin or freewheel. Accordingly, as evidenced by the test results shown above, the invention embodiment tested provides an improved braking force on the roll of bags, thereby improving the dispensing process by diminishing overspinning as a roll of bags is depleted. In addition, the tested embodiment of the invention was the only dispenser tested in which the force required to pull a bag forward from the smaller roll was consistently greater than the weight of the smaller roll.

In addition, it was observed during the testing that the smaller roll of bags was likely to jump out of the cradle dispenser when a relatively quick motion was used to dispense a bag. In addition, the cradle dispenser lacked adequate resistance or braking force to consistently engage bags on the smaller roll on the separator. It was also observed that bags in the commercial dispenser were also likely to jump out of the dispenser if the bags were pulled quickly in an upward motion, which is a practical scenario for use in commercial settings. By contrast, these disadvantages were not observed with dispensers of the present invention.

The tendency for a depleted roll of bags to overspin and jump out of the other dispensers may be due in part to the increasing spin speed of the roll of bags as the bags become depleted. In particular, when a user pulls at a rate of 22 inches per second, a 7-inch diameter roll of bags will rotate at approximately 1 revolution per second. By contrast, when a 1.4-inch diameter roll of bags is pulled at the same rate, it will rotate at approximately 5 revolutions per second, which is nearly five times faster than the larger roll. This increased spin speed likely contributes to depleted rolls of bags overspinning or jumping from dispensers. However, with the configuration of the dispensers of the present invention, these unfavorable characteristics may be overcome.

Figure 12:
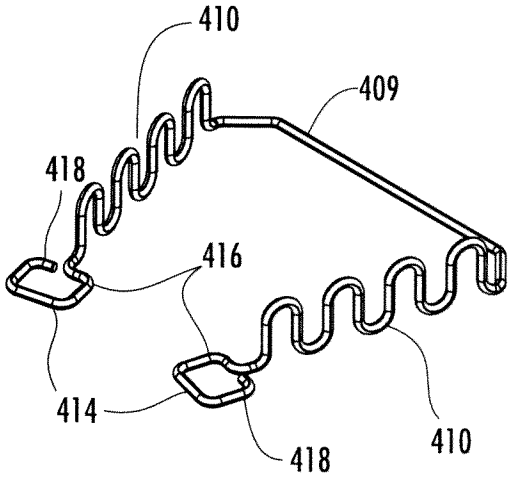
FIG. 12 is a perspective view of an alternative embodiment of support arms, tabs, and spring coils that can be used with various embodiments of dispensers of the present invention.
Figure 11:
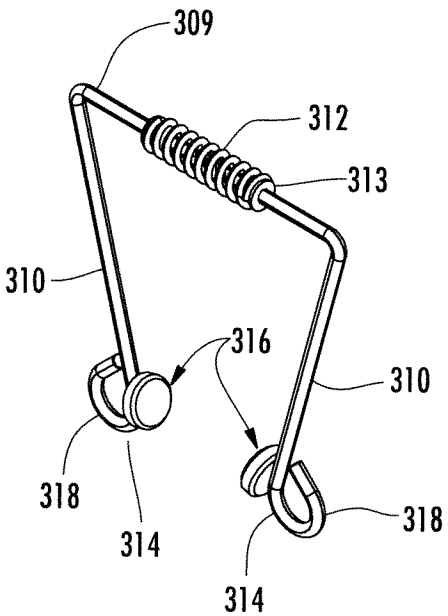
FIG. 11 is a perspective view of an alternative embodiment of support arms, tabs, and spring coils that can be used with various embodiments of dispensers of the present invention.
Figure 10:
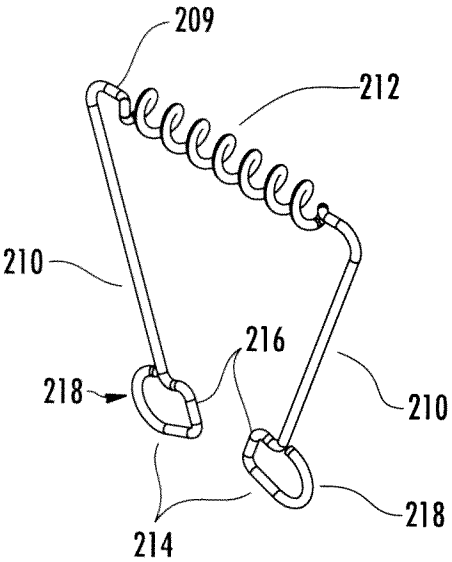
FIG. 10 is a perspective view of an alternative embodiment of support arms, tabs, and spring coils that can be used with various embodiments of dispensers of the present invention.

FIGS. 10-12 depict illustrative alternative embodiments of components that can be used with dispensers of the present invention. The various examples of components shown in FIGS. 4 and 10-12 are all designed in a manner so that when used with a particular dispenser embodiment, a sufficient force is applied to a roll of bags to reduce or eliminate overspinning during dispensing. These examples are illustrative in nature and do not exclude other embodiments from within the scope of the present invention.

For instance, FIG. 10 shows two support arms 210, spring coil 212, and tabs 214 formed from wire 209. Tabs 214 are biased inwardly towards each other and have an inner engagement tab 216 and an outer grasping tab 218. In this embodiment, spring coil 212 is a single set of multiple coils. Although the components in this embodiment and other illustrative embodiments are shown as integrally formed from wire 209, some or all of these components may not be integral in other embodiments.

FIG. 11 shows support arms 310, spring coil 312, and tabs 314 formed from wire 309. As depicted, tabs 314 are biased inwardly towards each other and have an inner engagement tab 316 and an outer grasping tab 318. In this embodiment, inner engagement tabs 316, which are shown as loops of wire for grasping by the user, are not integral to the support arms 310 but are attached by any conventional means, such as welding or bonding. In addition, spring coil 312 is shown as a single coil set (which has multiple coils therein) and is not integrally formed from the same wire forming support arms 310. Instead, in this depicted embodiment, spring coil holder 313 is attached to wire 309 at each end of spring coil 312 (although only one spring coil holder 313 can be seen from the view in FIG. 11). This attachment can be by any conventional means, such as welding or bonding. Spring coil 312 may be coiled around wire 309 and freely held in position by spring coil holders 313.

In the embodiment in FIG. 11, the force of spring coil 312 may maintain or aid in maintaining support arms 310 in a default resting position so that tabs 314 are biased inward. When tabs 314 are separated to load a roll of bags, spring coil 312 may be compressed and exert a force so that tabs 314 exert an inward force on a loaded roll of bags of a magnitude to provide the aforementioned braking force on a roll of bags. In this illustrated embodiment, the distance between tabs 314 may be less than the width of a roll of bags for use in dispenser 300. In addition, the number of coils in spring coil 312 can vary in alternative embodiments and as suitable for particular applications. In other embodiments, wire 309 may be comprised of two separate wires that are joined (such as with a hinge or other conventional means) at a location within the portion where spring coil 312 is located. In such embodiments, the force exerted by spring coil 312 may be increased due to such a hinged construction.

FIG. 12 depicts an alternative embodiment of the support arms 410 of the present invention. In this embodiment, wire 409 forms support arms 410 and tabs 414. As illustrated, support arms 410 are shaped such that they serve as S-shaped springs, which may increase the deflection, range of motion, and potential inward bias of support arms 410. In addition, tabs 414 are biased inwardly towards each other and have an inner engagement tab 416 and an outer grasping tab 418.

Figure 13B:
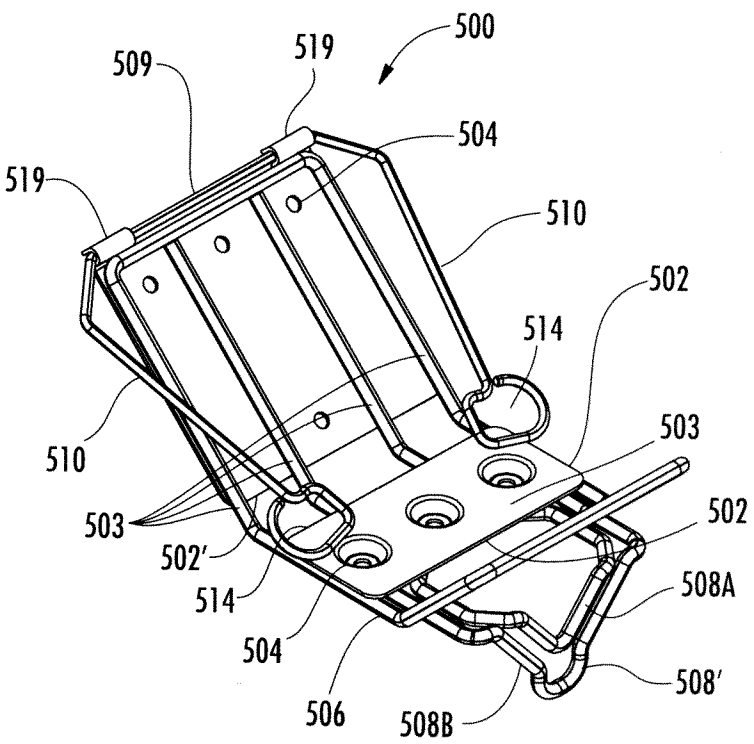
FIG. 13B is a perspective view of an alternative embodiment of a dispenser of the present invention.
Figure 13A:
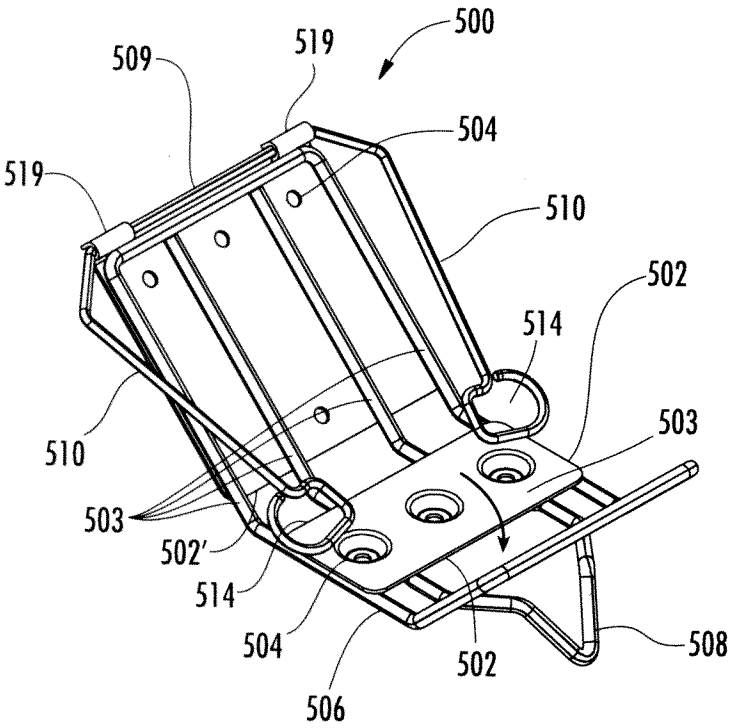
FIG. 13A is a perspective view of an alternative embodiment of a dispenser of the present invention.

To further illustrate the scope of the present invention, another dispenser embodiment is shown in FIG. 13A. In this embodiment, dispenser 500 is constructed of frame 506. Plate 502 and plate 502' are mounted on frame 506, and plate 502 has braking surface 503. In addition, the upper portion of frame 506 has braking surface 503. As shown, plate 502' is mounted on the outside of frame 506. In alternative embodiments, plate 502' can be mounted on the inner side of frame 506 in order to contact a loaded roll of bags such that the upper surface may serve as a braking surface. In other embodiments, both plate 502 and plate 502' can be omitted and the roll of bags can rest upon and contact frame 506 directly so that frame 506 itself serves as the braking surface.

As depicted in FIG. 13A, frame 506 and plate 502 form a cradle structure that corresponds with the cradle structure formed by plate 102 in dispenser 100 shown in FIG. 1. Plates 502 and 502' also include mounting holes 504. Dispenser 500 also includes separator 508 that is integral with frame 506 and extends in a downward direction. A single wire, which is attached to frame 506 by holders 519, forms support arms 510, and each support arm 510 has tab 514 on its distal end. Tabs 514 are biased inwardly towards each other and have inner engagement tab 516 and outer grasping tab 518.

As in previously described embodiments, support arms 510 are capable of swiveling in a direction to continually engage a roll of bags with braking surface 503 as the roll of bags is depleted. However, in contrast to the previously-described embodiments, dispenser 500 does not have any spring coils on support arms 510. Instead, as depicted in this embodiment, tabs 514 are biased inwardly solely by the bending or angling of support arms 510. Also, in this embodiment, as bags are being unwound from the roll for dispensing, the bags may pass through the open portion of frame 506 at the distal end of dispenser 500 as shown by the arrow. In this manner, frame 506 can also function as a guide channel for the bags being dispensed. To engage separator 508, the bag being dispensed may be pulled in a slightly upward direction.

For further illustration, FIG. 13B, depicts an identical dispenser to FIG. 13A except that separator 508' of FIG. 13B is depicted as a double tongue. In this embodiment, a bag is dispensed in the same manner as described with FIG. 13A, except the bags are also pulled between upper wire 508A and lower wire 508B that form separator 508'. The bag being dispensed may be pulled slightly upward to engage the perforation of the bag against upper wire 508A forming separator 508', such that a perforation tears and separates the bag being dispensed from the subsequent bag in the roll. In this manner, separator 508' also serves the function of guiding the bag during dispensing.

It will be evident to one of ordinary skill in the art that components illustrated in the various illustrative embodiments herein can be interchanged into other embodiments of the invention, just as separator 508 and 508' in FIGS. 13A and 13B can be altered and remain within the scope of the present invention. In addition, it will be apparent to a person of ordinary skill in the art that alternative embodiments of depicted components, such as alternative separators, are known and can be used within the scope of the dispensers of the present invention.

Figure 14:
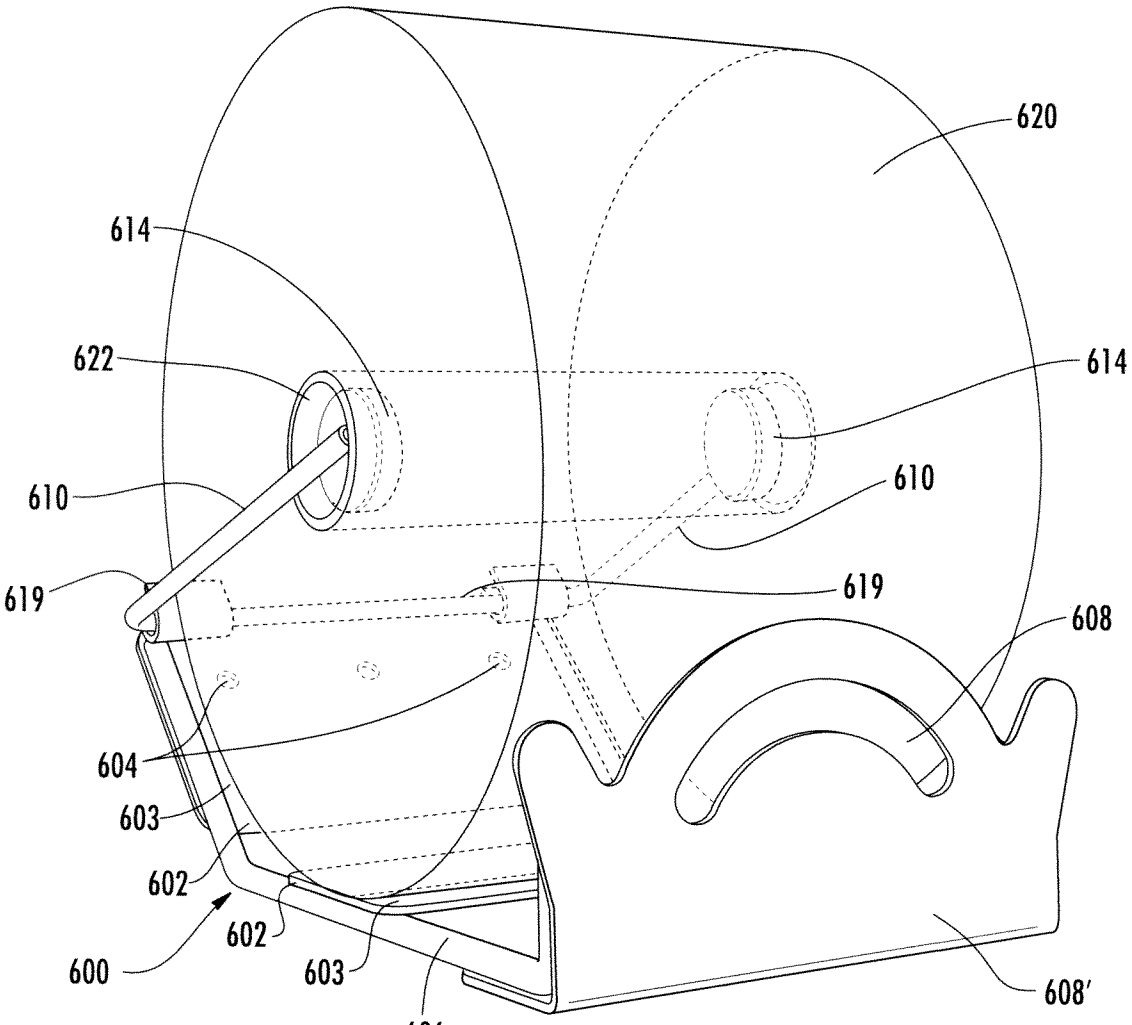
FIG. 14 is a perspective view of an alternative embodiment of a dispenser of the present invention having a roll thereon show in shadow.

FIG. 14 provides another illustrative embodiment of a dispenser of the present invention that has a roll of bags 620 with core 622 loaded thereon. In this embodiment, dispenser 600 is constructed of a frame 606, which has plates 602 mounted thereon. Frame 606 and plates 602 form a cradle position. As shown, plates 602 may optionally have a plurality of mounting holes 604. In addition, plates 602 have braking surfaces 603, which may contact roll of bags 620. In alternative embodiments, plates 602 may be integral with each other and with plate 608', and in such embodiments frame 606 can optionally be excluded.

Support arms 610 are attached to plate 602 by holders 619 and may be capable of swiveling in an up and down direction. Although support arms are depicted as formed from a single piece of wire, in other embodiments support arms 610 may be nonintegral to each other and each support arm 610 may be independently attached to plate 602. Tabs 614 are adjoined to the distal end of each support arm 610. In this embodiment, tabs 614 do not include an outer grasping tab to assist in separating tabs 614. In this depicted embodiment, separator 608 is a slot formed within plate 608'. In this embodiment, a user pulls the outermost bag on a loaded roll of bags through separator 608, which then aids in tearing the perforation on the series of bags to dispense a bag.

Figure 15:
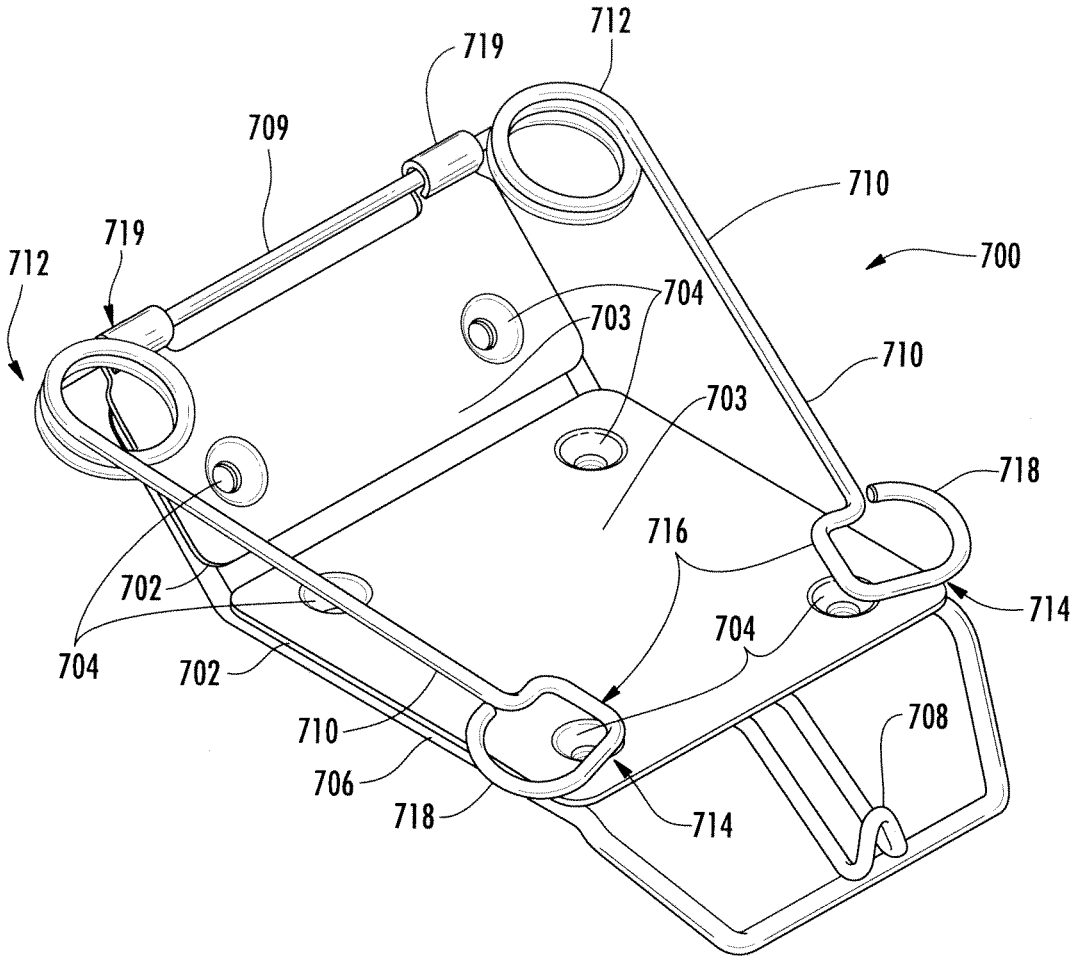
FIG. 15 is a perspective view of an alternative embodiment of a dispenser of the present invention.

FIG. 15 shows dispenser 700 constructed of frame 706 with plates 702 mounted thereon. As shown, plates 702 include braking surfaces 703 and mounting holes 704. Dispenser 700 also includes support arms 710, spring coils 712 (depicted as each having two coils), and tabs 714. Tabs 714 are biased inwardly towards each other and have inner engagement tab 716 and outer grasping tab 718. As illustrated, wire 709 is also attached to dispenser 700 by holder 719, and wire 709 forms two support arms 710, two spring coils 712, and tabs 714. However, it will be appreciated, as with other illustrative embodiments disclosed herein, that these components can be nonintegral.

Figure 16:
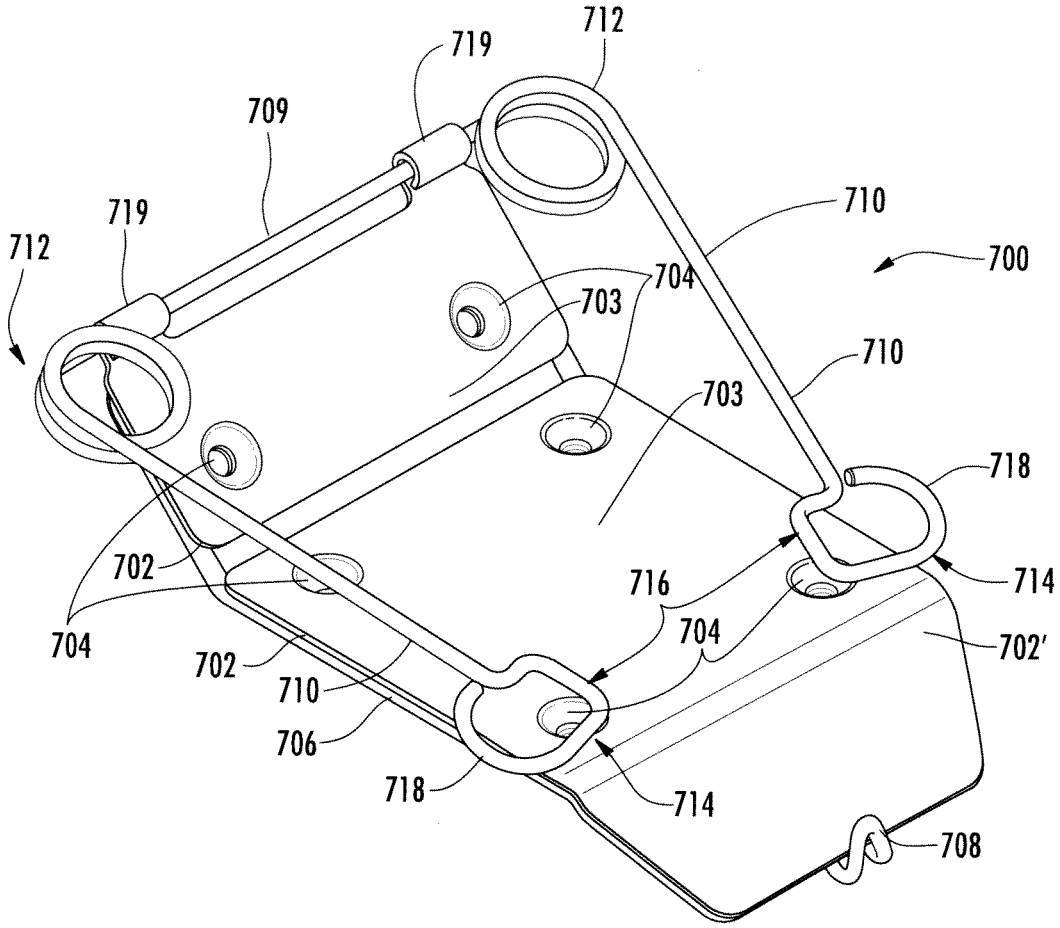
FIG. 16 is a perspective view of an alternative embodiment of a dispenser of the present invention.

Unlike the three-sided cradle structure depicted in FIGS. 1 and 3, plates 702 in FIG. 15 form a two-sided cradle structure in which braking surfaces 703 contact a roll of bags when loaded on the dispenser. As illustrated with respect to the dispenser embodiment in FIGS. 8A-8C, it is appreciated that each of braking surfaces 703 may not contact the roll at all points of dispensing and less contact with braking surfaces 703 may be present as a roll of bags is depleted. Dispenser 700 also has separator 708. For illustration of an alternative embodiment, FIG. 16 shows dispenser 700 wherein plate 702' is extended as compared with plate 702 in FIG. 15. In yet other embodiments, the extended portion of plate 702' in FIG. 16 could consist of a separate plate that is mounted separately upon frame 706.

Figure 17:
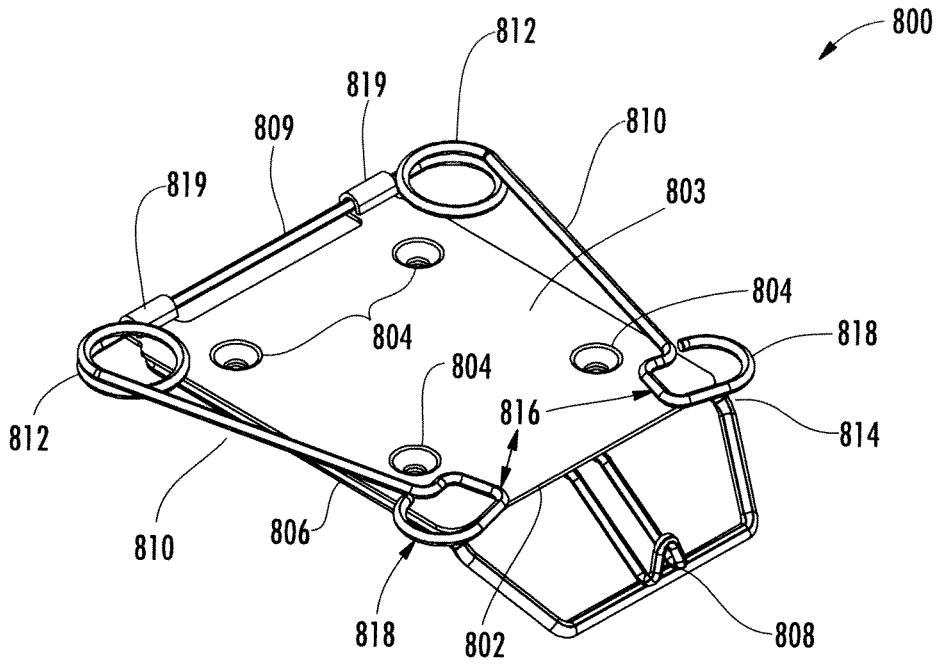
FIG. 17 is a perspective view of an alternative embodiment of a dispenser of the present invention.

FIG. 17 depicts dispenser 800 having plate 802 mounted on frame 806. In addition, plate 802 has a braking surface 803 and mounting holes 804. In contrast to the two-sided and three-sided cradle structures discussed in previous embodiments of the present invention, dispenser 800 only has a single braking surface 803 and plate 802 is planar. Dispenser 800 also includes separator 808. As with other embodiments disclosed herein, it will be appreciated that separator 808, which is shown as integral with frame 806, can be nonintegral and alternatively attached or mounted to frame 806, plate 802, or both.

Dispenser 800 includes wire 809 that forms support arms 810, spring coils 812, and tabs 814, which may be separately formed and attached to one another in alternative embodiments. Holders 819 attaches wire 809 to plate 802 in a manner that permits support arms 810 to swivel in a vertical direction. In addition, tabs 814 may be biased inwardly towards each other and have inner engagement tab 816 and outer grasping tab 818. Dispenser 800 also includes separator 808, which is shown as a tongue. As compared with dispenser 100 in FIG. 1, in which spring coils 112 have three coils, spring coils 812 each have one coil.

Although the present invention includes different shapes of the plates carrying the braking surface, the three-sided cradle structure offers more contact with a roll of bags and thereby provides a greater force to avoid overspin. In addition, these structures may advantageously provide for centering the roll of bags in the front and back direction of the dispenser and maintain and securing that position and any unwanted movement of the roll of bags.

The foregoing description of illustrative embodiments of the invention has been presented only for the purpose of illustration and description and is not intended to be exhaustive or to limit the invention to the precise forms disclosed. Numerous modifications and adaptations thereof will be apparent to those of ordinary skill in the art without departing from the scope of the present invention.

It will be understood that each of the elements described above, or two or more together, may also find utility in applications differing from the types described. While the invention has been illustrated and described in the general context of bag dispensers, it is not intended to be limited to the details shown, since various modifications and substitutions can be made without departing in any way from the spirit and scope of the present invention. As such, further modifications and equivalents of the invention herein disclosed may occur to persons skilled in the art using no more than routine experimentation, and all such modifications and equivalents are believed to be within the spirit and scope of the invention as described herein.

What is claimed is:

1. A dispenser for bags comprising:

(a) one or more braking surfaces for contacting a portion of a wound roll of bags;

(b) two support arms configured to receive a wound roll of bags therebetween, wherein each of the two support arms is angled toward the other arm at an angle less than 90° at a default resting position in which a wound roll of bags is not loaded in the dispenser;

(c) at least one tab on each of the two support arms configured to engage a core of the wound roll of bags and to provide an inward force against the wound roll of bags, wherein the tabs comprise an outer grasping tab, wherein the outer grasping tab comprises at least a partial loop extending from the support arm directionally away from the roll of bags;

wherein the two support arms are positioned relative to the one or more braking surfaces so as to allow the wound roll of bags to contact at least one of the braking surfaces when the core of the wound roll of bags is engaged by the tabs and wherein the two support arms are configured to swivel so that the wound roll of bags remains in contact with at least one of the braking surfaces as the wound roll of bags is depleted; and (d) a separator positioned relative to the braking surface to separate an individual bag from the wound roll of bags.

2. The dispenser of claim 1 wherein the support arms are configured to swivel at a mounting point such that the roll of bags maintains a constant distance from the separator as bags are dispensed.

3. The dispenser of claim 1 wherein the tabs are configured to engage an inner portion of the core of the wound roll of bags.

4. The dispenser of claim 3 wherein the dispenser further comprises a frame and at least one of the one or more braking surfaces comprises an upper portion of the frame.

5. The dispenser of claim 3 wherein the dispenser further comprises a wire frame and the one or more braking surfaces comprises an upper surface of a plate mounted on the wire frame.

6. The dispenser of claim 1 wherein the one or more braking surfaces form a cradle shape.

7. The dispenser of claim 6 wherein the cradle shape is a three-sided cradle shape.

8. The dispenser of claim 1 wherein an innermost distance between the tabs when at a default resting position is less than the width of the least wide roll of bags for use with the dispenser.

9. The dispenser of claim 1 wherein the two support arms and the tab on each support arm are integral and the two support arms form a u-shape.

10. The dispenser of claim 1 wherein each of the two support arms is connected to a spring coil.

11. The dispenser of claim 10 wherein the spring coil comprises at least three coils.

12. The dispenser of claim 10 wherein the two support arms, each tab on each support arm, and the spring coil connected to each support arm are integral and the support arms form a u-shape.

13. The dispenser of claim 1 wherein the tabs are biased inwardly at a force of about 1 pound of pressure per one inch of deflection.

* * * * *